United States Patent [19]

Cahill et al.

[11] Patent Number: 4,647,293

[45] Date of Patent: Mar. 3, 1987

[54] GASOLINE COMPOSITIONS CONTAINING HEXAVALENT MOLYBDENUM

[75] Inventors: Paul J. Cahill; Larry C. Satek, both of Wheaton, Ill.

[73] Assignees: William H. Magidson; Standard Oil Company (Indiana), Chicago, Ill.

[21] Appl. No.: 833,225

[22] Filed: Feb. 24, 1986

Related U.S. Application Data

[63] Continuation of Ser. No. 362,317, Mar. 26, 1985, abandoned, which is a continuation-in-part of Ser. No. 190,592, Sep. 25, 1980, abandoned.

[51] Int. Cl.[4] ..... C10L 1/30

[52] U.S. Cl. ..... 44/68; 44/77

[58] Field of Search ..... 44/68, 77

[56] References Cited

U.S. PATENT DOCUMENTS

| | | | |
|---|---|---|---|
| 3,003,859 | 10/1961 | Irish et al. | 44/68 |
| 3,282,838 | 11/1966 | Knowles et al. | 44/68 |
| 4,266,945 | 5/1981 | Karn | 44/68 |

*Primary Examiner*—Jacqueline V. Howard

*Attorney, Agent, or Firm*—Matthew R. Hooper; William T. McClain

[57] ABSTRACT

An unleaded gasoline in combination with a minor amount of gasoline soluble molybdenum(VI) compound is effective in reducing elevated steady state octane requirement and suppressing octane requirement increase in spark ignition internal combustion engines.

11 Claims, No Drawings

GASOLINE COMPOSITIONS CONTAINING HEXAVALENT MOLYBDENUM

CROSS-REFERENCE TO RELATED APPLICATIONS

This is a continuation of patent application Ser. No. 362,317, filed Mar. 26, 1985, now abandoned, which is a continuation-in-part of patent application Ser. No. 190,592, filed Sept. 25, 1980, now abandoned.

BACKGROUND OF THE INVENTION

1. Field of the Invention.

This invention relates to improved unleaded gasoline compositions. More particularly, the invention relates to the incorporation of molybdenum(VI) compounds into an unleaded gasoline for the purpose of reducing elevated steady state octane requirement and suppressing octane requirement increase in spark ignition internal combustion engines.

2. Description of the Prior Art.

A great number of gasoline additives, including antiknock agents, deposit reducing agents, demulsifiers, etc., have been developed in recent years. A commercially important antiknock agent, tetraalkyl lead, has, until recently, been universally used to prevent engine knock by increasing the octane number of gasoline. However, with increased sensitivity to lead in the environment and with the use of catalytic converters that can be poisoned by lead, broad restrictions have been placed on the use of lead in gasoline. In the absence of lead, greater amounts of expensive, high octane blending stock must be used to produce gasoline having sufficient octane for current production automobiles.

Along with the increased cost of production of unleaded gasoline, a particularly harmful problem has arisen. Engines operating on unleaded gasoline commonly experience increasing incidence and severity of knock as they age. A new or "clean" engine can operate efficiently and without knock using a gasoline having a research octane number of about 85. The same engine with about 8,000–12,000 accumulated miles can often require a gasoline having an octane number about 95–100 or higher. This increase in the octane number required to prevent knock is called octane requirement increase (ORI).

ORI is believed to be one result of thermally insulating combustion chamber deposits formed from gasoline contaminants and from the incomplete combustion of gasoline and lubricating oil. Initially the rate of deposit formation is substantially greater than the rate of disintegration, and the deposits rapidly build. As the deposits thicken, the rate of disintegration approaches and eventually equals the rate of formation. At this point, the deposits reach a steady state thickness. Knock in the engine appears to increase in incidence and severity as the deposit builds and reaches a constant or steady state elevated rate of incidence and severity corresponding to the steady state thickness of the deposit. At this point the engine commonly has an elevated steady state octane requirement which can be 2 to 15 research octane numbers greater than the octane requirement when new.

While we do not wish to be limited to a theory of ORI, we believe that the combustion chamber deposits have the substantial ability to prevent transfer of thermal energy from the combustion chamber into engine coolant, causing accumulation of thermal energy in the deposits and in the combustion chamber. When a spark ignites the air/fuel mixture in the combustion chamber, a flame front is initiated and combustion rapidly and smoothly progresses from the spark plug to the "end-gas region" opposite to the spark plug. The high pressure flame front rapidly compresses the unburned air/fuel mixture which is at a relatively lower pressure in the end-gas region as the front progresses through the chamber. Commonly, the combustion progresses through the combustion chamber, and knock is not heard. However, if the temperature of the combustion chamber and the air/fuel mixture has been substantially increased by the insulating properties of the deposits, the rapid compression of the air/fuel mixture in the end-gas region causes an immediate autodetonation which is different than normal progressive combustion. This autodetonation causes the "knocking" or "pinging" sound, can reduce operating efficiency and can cause engine damage. See J. D. Benson, "Some Factors Which Affect Octane Requirement Increase," SAE Paper 750933, Detroit, Mich., October 1975, for a detailed treatment of ORI.

ORI can readily be remedied with leaded gasoline by increasing the lead concentration. In unleaded fuels, a greater amount of high octane blending stock must be used to increase the octane. However, high octane blending stock commonly contains aromatic constituents that are more likely to leave thermally insulating deposits and increase ORI.

With the suppression of ORI, more gasoline with a lower octane number could be produced per barrel of crude oil at lower cost. Since the production of high octane gasoline consumes more energy than the production of lower octane gasoline, refining operations would become more energy efficient. Further, in the absence of ORI, engine manufacturers could build more fuel efficient engines by increasing compression and adjusting spark timing. Such engines would perform satisfactorily with a fuel having the same or lower octane as is currently available.

In this application, octane requirement increase shall mean the gradual increase in octane requirement observed as an engine ages. Elevated steady state octane requirement shall mean the octane requirement of an engine with combustion chamber deposits that have reached a steady state both in thickness and in resistance to thermal energy flow.

The incorporation of certain specific molybdenum compounds into gasoline has been suggested for the purpose of providing a composition having improved lubricating and antiwear properties. U.S. Pat. Nos. 4,164,473; 4,176,073; and 4,176,074 disclose the use of molybdenum complexes of hydroxy amines, molybdenum complexes of lactone oxazoline dispersants, and molybdenum complexes of oxazoline dispersants respectively for this purpose. Similarly, U.S. Pat. Nos. 4,192,757 and 4,201,683 disclose, for this purpose, the use of molybdenum complexes which are obtained by reaction of a hydrocarbyl substituted thio-bis-phenol with a molybdenum compound in the presence of an amine in an alkyl substituted phenol or alkanol solvent, respectively. In addition, U.S. Pat. No. 3,994,697 teaches that a solid pellet comprising various metals in combination with molybdenum disulfide can be placed in the fuel reservoir of an internal combustion engine where it slowly disintegrates to produce extremely minute particles which are dispersed in the fuel and are delivered to the fuel-contacting parts of the engine to deposit a lubricant film thereon.

U.S. Pat. Nos. 3,615,293 and 3,755,195 disclose the incorporation of various organic molybdenum compounds into a gasoline fuel which contains an organomanganese antiknock agent. These patents teach that the molybdenum compounds are effective in reducing spark plug fouling by gasoline fuels which contain organomanganese antiknock agents. It is further disclosed that suitable organic molybdenum compounds include molybdenum salts and chelates. However, these references fail to suggest the incorporation of a molybdenum compound into gasoline for any purpose in the absence of an organomanganese antiknock agent.

U.S. Pat. No. 3,317,571 discloses the preparation of organomolybdenum compounds wherein one or more molecules containing an amide or thioamide linkage are bonded to the molybdenum atom through a sulfur or oxygen linkage and which is stabilized by additional covalent bonding to a plurality of carbonyl groups. This patent discloses that such compounds can be used in gasoline, either alone or in combination with lead alkyls, as antiknock agents. It fails, however, to either teach or suggest the use of a molybdenum(VI) compound for any purpose.

U.S. Pat. No. 3,272,606 discloses that small amounts of a covalent molybdenum polycarbonyl compound can be used in gasoline in combination with an organolead antiknock agent to enhance the antiknock properties of the organolead antiknock agent. However, this reference fails to suggest the incorporation of a molybdenum compound into gasoline for any purpose in the absence of an organolead antiknock agent.

U.S. Pat. No. 2,086,775 is directed to the incorporation of various organometallic compounds into a liquid fuel for an internal combustion engine. Suitable organometallic compounds are those of cobalt, nickel, manganese, iron, copper, uranium, molybdenum, vanadium, zirconium, beryllium, platinum, palladium, thorium, chromium, aluminum, and the rare earth metals. In addition, the liquid fuel may also contain an organolead antiknock agent. It is disclosed that use in an internal combustion engine of a fuel containing small amounts of these organometallic compounds results in the formation of a catalytic deposit within the combustion chambers of the engine which is effective for the elimination of knock and the improvement of combustion within the engine. However, this patent offers no guidance for selecting a molybdenum(VI) compound for use in a gasoline composition which is substantially free of other metals for the purpose of suppressing octane requirement increase and reducing elevated steady state octane requirement in spark ignition internal combustion engines.

U.S. Pat. No. 3,155,620 is directed to the use of cycloheptatriene transition metal coordination compounds of the Group VIB metals as additives for liquid hydrocarbon compositions. This patent teaches that such additives can be used to increase the octane of liquid fuels and to provide improved lubricating properties when incorporated into lubricating oil compositions. It is further disclosed that these coordination compounds can be used in combination with antiknock agents such as organolead compounds. However, this patent fails to either teach or suggest the use of a molybdenum(VI) compound for any purpose.

U.S. Pat. No. 3,440,028 is directed to the incorporation of a metal halide hydrocarbyl orthophosphate additive into leaded gasoline compositions for the purpose of suppressing the tendency of the lead to increase undesirable surface ignition within the combustion chambers of an engine. The metal of the additive can be selected from the group consisting of manganese and metals of Groups IB, IIA, IIB, IVA, VIB and VIII of the Periodic Table. Similarly, U.S. Pat. No. 3,240,576 discloses that the addition to leaded gasoline of a gasoline soluble organomolybdenum compound will provide a substantial reduction of surface ignition in the combustion chambers of a spark ignition internal combustion engine. These patents do not, however, suggest the addition of a molybdenum compound to unleaded gasoline for any purpose.

U.S. Pat. No. 3,401,184 is directed to a method for the preparation of metal organo orthophosphates wherein the metal can be selected from Groups II, IV, VI and VIII of the Periodic Table. It is disclosed that these compounds have utility as gasoline additives and that when so used they impart rust inhibition, surface ignition suppression, carburetor detergency, carburetor icing alleviation and reduction in octane requirement increase to the gasoline composition. In addition, U.S. Pat. No. 3,282,838 discloses the use of amine salts of chromic or molybdic acid as corrosion inhibitors in petroleum hydrocarbons such as gasoline. These amine salts contain either a chromic or molybdic ion of +6 valence and are used at a concentration level between about 0.005 and 5 weight percent.

Finally, U.S. Pat. No. 3,003,859 discloses the incorporation into a liquid hydrocarbon, such as gasoline, of about 0.005 to about 5 percent by weight of a metal-organic material which is obtained by heating a normally-solid metallic chelate compound formed from a beta-keto ester to a temperature above its melting point. It is further disclosed that these metal chelates can be formed from metallic elements of the Periodic Table comprising the Groups IA, IB, IIA, IIB, IIIA, IIIB, IVA, IVB, VA, VB, VIB, VIIB and VIII including the lanthanide and actinide series of rare earth elements. This patent, however, fails to offer any guidance for selecting a molybdenum(VI) compound for the purpose of suppressing octane requirement increase and reducing elevated steady state octane requirement in spark ignition internal combustion engines.

SUMMARY OF THE INVENTION

The present invention is directed to the discovery that the incorporation of small amounts of a gasoline soluble molybdenum(VI) compound into unleaded gasoline affords a fuel composition which is effective in reducing elevated steady state octane requirement and suppressing octane requirement increase in spark ignition internal combustion engines.

One embodiment of the invention is a gasoline fuel composition comprising a major proportion of a liquid hydrocarbon fuel of gasoline boiling range in combination with a molybdenum(VI) compound which is soluble in said hydrocarbon fuel, wherein the amount of said molybdenum(VI) compound is from about 0.1 to about 20.0 parts per one million parts of hydrocarbon fuel, said fuel composition is substantially free of metals other than molybdenum, and said molybdenum(VI) compound is selected from the group consisting of molybdenum(VI) sulfonates, molybdenum(VI) diamine complexes, amine salts of molybdic acid and isopolymolybdic acid, and molybdenum(VI) compounds which are free of nitrogen, sulfur and phosphorus.

Another embodiment of the invention is a gasoline fuel composition comprising a major proportion of a liquid hydrocarbon fuel of gasoline boiling range in combination with a molybdenum(VI) compound which is soluble in said liquid hydrocarbon fuel, wherein the amount of said molybdenum(VI) compound is effective to suppress octane requirement increase in a spark ignition internal combustion engine, said fuel composition is substantially free of metals other than molybdenum, and said molybdenum(VI) compound is selected from the group consisting of molybdenum(VI) sulfonates, molybdenum(VI) diamine complexes, amine salts of isopoly molybdic acid, and molybdenum(VI) compounds which are free of nitrogen, sulfur and phosphorus.

Another embodiment of the invention is a gasoline fuel composition comprising a major proportion of a liquid hydrocarbon fuel of gasoline boiling range in combination with a molybdenum(VI) compound which is soluble in said liquid hydrocarbon fuel, wherein the amount of said molybdenum(VI) compound is effective to reduce elevated steady state octane requirement in a spark ignition internal combustion engine, said fuel composition is substantially free of metals other than molybdenum, and said molybdenum(VI) compound is selected from the group consisting of molybdenum(VI) sulfonates, molybdenum(VI) diamine complexes, amine salts of isopoly molybdic acid, and molybdenum(VI) compounds which are free of nitrogen, sulfur and phosphorus.

A further embodiment of the invention is a method for reducing elevated steady state octane requirement in a spark ignition internal combustion engine and maintaining the resulting reduced steady state octane requirement which comprises operating said engine on a first gasoline fuel composition until a reduced steady state octane requirement is achieved and maintaining said reduced steady state octane requirement by operating the engine on a second gasoline fuel composition, wherein said first fuel comprises a major proportion of a liquid hydrocarbon fuel of gasoline boiling range in combination with an amount of a soluble molybdenum(VI) compound which is sufficient to provide from about 10 to about 1000 parts of molybdenum per million parts of liquid hydrocarbon fuel, wherein said second fuel comprises a major proportion of a liquid hydrocarbon fuel of gasoline boiling range in combination with an amount of a soluble molybdenum(VI) compound which is sufficient to provide from about 0.01 to about 10 parts of molybdenum per million parts of liquid hydrocarbon fuel, and wherein both of said first and second fuels are substantially free of lead.

A further embodiment of the invention is a method for reducing elevated steady state octane requirement and/or suppressing octane requirement increase in a spark ignition internal combustion engine which comprises operating said engine with a gasoline fuel composition comprising a major proportion of a liquid hydrocarbon fuel of gasoline boiling range in combination with a molybdenum(VI) compound which is soluble in said liquid hydrocarbon fuel, wherein the amount of said molybdenum(VI) compound is effective to reduce elevated steady state octane requirement and/or suppress octane requirement increase in said engine, said fuel composition is substantially free of metals other than molybdenum, and said molybdenum(VI) compound is selected from the group consisting of molybdenum(VI) sulfonates, molybdenum(VI) diamine complexes, amine salts of molybdic acid and isopoly molybdic acid, and molybdenum(VI) compounds which are free of nitrogen, sulfur and phosphorus.

A still further embodiment of the invention is a method for reducing elevated steady state octane requirement in a spark ignition internal combustion engine having an increased octane requirement of about 2 to about 7 units after operation with gasoline substantially free of lead and molybdenum which comprises operating said engine with a gasoline fuel composition comprising a major proportion of a liquid hydrocarbon fuel of gasoline boiling range in combination with a molybdenum(VI) compound which is soluble in said hydrocarbon fuel, wherein the amount of said molybdenum(VI) compound is sufficient to provide from about 10 to about 1000 parts of molybdenum per million parts of said hydrocarbon fuel, and the amount of said gasoline fuel composition is effective to reduce said elevated steady state octane requirement by at least about 20%.

The general object of this invention is to suppress ORI and reduce elevated steady state octane requirement arising in internal combustion engines using unleaded fuels. Another object is to modify the thermal conductivity of combustion chamber deposits to increase heat conduction and thereby reducing elevated steady state octane requirement and suppressing ORI. Still another object of the invention is to promote the formation of thermally conductive deposits in internal combustion engines. A further object of the invention is to provide low octane gasoline that can be used in an engine without harmful knock arising as the engine ages. A still further object of the invention is to increase the efficiency of gasoline production by producing more low octane gasoline from crude oil.

DETAILED DESCRIPTION OF THE INVENTION

We have discovered that the octane requirement increase and the elevated steady state octane requirement caused by combustion chamber deposits in internal combustion engines can be prevented or reduced by operation of an internal combustion engine wherein the combustion processes in the combustion chamber are performed in the presence of a hexavalent molybdenum, molybdenum(VI) or molybdenum +6 compound. The hexavalent molybdenum compound can be provided to the combustion chamber by a gasoline substantially free of lead compounds containing a gasoline soluble hexavalent molybdenum compound, or by a lubricating oil containing the molybdenum compound which is transported into the combustion chamber during the operation of the engine. We have further discovered certain preferred hydrocarbon soluble compounds containing molybdenum in the +6 oxidation state that are effective in preventing octane requirement increase and are effective in reducing elevated steady state octane requirement.

The generic use of molybdenum compounds of any oxidation state to prevent octane requirement increase and reduce elevated steady state octane requirement is disclosed in U.S. patent application Ser. No. 190,591, filed Sept. 25, 1980. However, we have found that only molybdenum(VI) compounds serve to efficiently afford these results. Apparently, only molybdenum(VI) compounds efficiently alter the thermal energy transfer characteristics of combustion chamber deposits so that heat can be rapidly conducted from combustion chamber to engine coolant. Since the modified deposits no longer impede efficient removal of heat from the combustion chamber, the gasoline is ignited solely by the spark and the fuel is burned uniformly in the combustion chamber, efficiently transmitting combustion energy to the road in the absence of knock, ping, loss in efficiency or mechanical damage.

Although the subject invention is not to be so limited, it is believed that a greater thermal conductivity per unit mass of combustion chamber deposit results from higher levels of organic oxygen and that such highly oxidized deposits are generated efficiently in the presence of molybdenum only when the molybdenum is in the +6 oxidation state. In principle, molybdenum of lower oxidation state could be oxidized to the +6 oxidation state within an engine during the combustion of fuel. However, the conditions under which gasoline is combusted in a spark ignition internal combustion engine appear to be unsuitable to render such a process of significance. Among other possible factors, it is believed that the fuel combustion cycles are too short to effect such a modification of molybdenum oxidation state.

Briefly, the improved gasoline compositions of this invention can be prepared by combining with a major portion of gasoline substantially free of lead compounds an effective octane requirement increase suppressing or an effective steady state octane requirement reducing amount of a gasoline soluble compound containing molybdenum(VI), hexavalent molybdenum, or molybdenum +6. The improved lubricants of the invention can be prepared by combining with a lubricant an effective amount of a hydrocarbon soluble molybdenum(VI) compound.

One aspect of the invention is an unleaded gasoline, used in "clean," new engines, containing a low concentration of a hydrocarbon soluble molybdenum(VI) compound comprising a major portion of gasoline and about 0.1 to about 20 parts of the molybdenum(VI) compound per one million parts of gasoline. Alternatively, such a molybdenum(VI) compound can be used in an amount which is sufficient to provide from about 0.01 to about 10 parts of molybdenum, calculated as the metal, per million parts of gasoline.

Another aspect of the invention is a gasoline, for use in "dirty" engines that have reached an elevated steady state octane requirement caused by deposits in the combustion chamber, to substantially reduce the elevated steady state octane requirement. This composition, which modifies the existing deposits and reduces the elevated steady state octane requirement, comprises a major portion of gasoline and about 20 to about 10,000 parts of a hydrocarbon soluble molybdenum(VI) compound per one million parts of gasoline. Alternatively, such a molybdenum(VI) compound can be used in an amount which is sufficient to provide from about 10 to about 1000 parts of molybdenum, calculated as the metal, per million parts of gasoline.

A further aspect of the invention is a concentrate of a hydrocarbon soluble molybdenum(VI) compound containing about 0.1 to about 50 wt % of the compound in a suitable diluent which can be dissolved in proper proportion in gasoline or lubricating oil to provide about 0.1 to about 10,000 parts of molybdenum(VI) compound per one million parts of gasoline or about 0.001 to about 5 wt % of molybdenum(VI) compound in a lubricating oil.

A still further aspect of the invention is a lubricating oil containing a hydrocarbon soluble molybdenum compound which when used to lubricate an engine provides to the combustion chamber a substantial amount of molybdenum(VI), by oxidation of a molybdenum compound or by other means, that can suppress ORI or reduce elevated steady state octane requirement. Commonly, lubricating oils contain about 0.001 to about 5 wt %; preferably about 0.01 to about 2 wt %; and most preferably, to reduce molybdenum consumption and provide maximum benefit, about 0.01 to about 1 wt % of molybdenum(VI) compound.

Significant amounts of lead and manganese compounds have been widely used in gasoline as antiknock agents. Lead compounds, particularly tetraalkyl lead compounds, have been most extensively used, whereas manganese compounds have been primarily used to enhance the antiknock properties of lead compounds. However, the molybdenum(VI) containing gasoline compositions of this invention are preferably substantially free of lead, more preferably substantially free of both lead and manganese, and most preferably substantially free of metals other than molybdenum.

Any hydrocarbon soluble molybdenum(VI) compound which is stable in hydrocarbon or petroleum storage or distribution facilities can be used in gasoline in accordance with this invention. Preferably, the molybdenum(VI) or compound is selected from the group consisting of molybdenum(VI) sulfonates, molybdenum(VI) diamine complexes, amine salts of molybdic acid and isopoly molybdic acid, and molybdenum(VI) compounds which are free of nitrogen, sulfur and phosphorus. More preferably, the molybdenum(VI) compound is selected from the group consisting of molybdenum(VI) sulfonates, molybdenum(VI) diamine complexes, amine salts of isopoly molybdic acid, molybdenum(VI) carboxylates, molybdenum(VI) salts of naphthenic acids, molybdenum(VI) phenates, molybdenum(VI) alkoxides, molybdenum(VI) aryloxides, and molybdenum(VI) beta-diketone complexes.

Although phosphorus containing compounds of molybdenum(VI) can be used in the practice of this invention, they are ordinarily not preferred. This is a consequence of the fact that phosphorus is considered to be harmful to the catalytic converters which are currently employed to control the emission of hydrocarbons, carbon monoxide and nitrogen oxides from automotive engines.

Molybdenum compounds useful to suppress ORI or reduce elevated steady state octane requirement include a broad variety of molybdenum(VI) compositions.

A useful class of molybdenum(VI) compositions can be formed by the reaction of molybdenum in a variety of forms with a ligand. Examples of these ligands are acetylacetone, N-nitrosophenylhydroxylamine, dimethylglyoxime, ethylenediamine, ethylenediaminetetraacetic acid, nitrilotriacetic acid, 8-hydroxyquinoline, benzoylacetone, 2,4-pentanediene, beta-diketones, oxygen, halogens, Mannich products, phosphates, phosphine oxides, alkanol amines, sulfoxides formamides and other similar well known chelating agents.

Another useful class of hydrocarbon soluble molybdenum compositions includes molybdenum(VI) beta-diketonates wherein the beta-diketone can be represented by the formula:

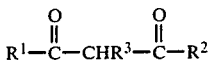

At least one proton on the carbon atom between the carbonyl groups is necessary for the formation of the molybdenum complex. The removal of this proton generates a beta-diketone anion which can chelate the metal ion present. $R^1$ and $R^2$ are hydrocarbyl groups of 1 to 50 carbon atoms and include primary, secondary and tertiary alkyl, alkenyl and aromatic groups. Preferred alkyl groups are methyl, ethyl, isopropyl, t-butyl, sec-amyl, 2-ethylhexyl, eicosyl, pentacontyl, having both normal chains and branched chains. $R^3$ can be hydrogen or a hydrocarbyl group of 1 to 50 carbon atoms. Preferably, $R^3$ is hydrogen or an alkyl group, for example methyl, ethyl, isopropyl, t-butyl, amyl, n-hexyl, pentacontyl, etc., having both normal and branched chain. Beta-diketones are well known in the art, some are available commercially, and all are readily prepared by methods well known in the art.

The commonly used compounds are prepared from beta-diketones wherein $R^1$ and $R^2$ represent alkyl groups of 1 to 20 carbon atoms and $R^3$ represents hydrogen. More specifically, the preferred beta-diketones are 2,4-pentanedione, 3-methyl-2,4-pentanedione, 3-isopropyl-2,4-pentanedione, 2,4-hexanedione, 2-methyl-3,5-hexanedione, 4-methyl-3,5-heptanedione, 3,5-heptanedione, 2,6-dimethyl-3,5-heptanedione, 2-methyl-4,6-heptanedione, 2-methyl-4,6-octanedione, 2,8-dimethyl-4,6-nonanedione, and 2,2,6,6-tetramethyl-3,5-heptanedione. Other beta-diketone complexes are discussed by Morgan and Castell, *J. Chem. Soc.*, 3252 (1928).

Another useful class of hydrocarbon soluble molybdenum(VI) complexes that can be used in the practice of this invention is composed of molybdenum(VI) diamine complexes wherein the diamine ligand is represented by:

$$R^4R^5N-(CR^4R^5)_n-NR^4R^5$$

wherein n is an integer from 1 to 20, preferably for reasons of stability of the molybdenum-amine product, n is 2 to 4. The $R^4$ and $R^5$ substituents can be independently hydrogen or alkyl of 1 to 20 carbon atoms and the amino groups can be independently primary, secondary or tertiary groups. Representative diamines include ethylenediamine, 1,2-propylenediamine, 1,3-propylenediamine, 2-methyl-1,3-diaminopropane, 2,2-dimethyl-1,3-diaminopropane, ortho-phenylenediamine and the corresponding 1 to 20 carbon alkyl-substituted diamines.

Other useful hydrocarbon soluble molybdenum(VI) compounds include molybdenum-polyamine Mannich complexes, molybdenum-polyamine substituted dicarboxylic acid complexes, disclosed in U.S. patent application Ser. No. 190,590, filed Sept. 25, 1980, which is expressly incorporated by reference herein.

Another useful class of molybdenum(VI) compositions includes the neutralization products of molybdic acid including iso and heteropoly molybdic acid with an oil soluble base and the neutralization of an acid with a molybdenum base.

Gasoline soluble amine salts of the formula:

$$[R^6R^7R^8NH]_2MoO_4$$

can be used in the practice of this invention wherein $R^6$ is a hydrocarbyl radical, and $R^7$ and $R^8$ are independently selected from the group consisting of hydrogen and hydrocarbyl. Typical hydrocarbyl radicals include, for instance: alkyl, alkenyl, aryl, alkaryl, arylalkyl, or alicyclic radicals. Examples of suitable hydrocarbyl radicals are: methyl, ethyl, propyl, butyl, isohexyl, 2-ethylhexyl, neodecyl, dodecyl, octadecyl, eicosyl, nonacosyl, phenyl, naphthyl, benzyl, cresyl, ethylphenyl, phenylhexyl, cyclohexyl, cyclopropyl, cyclopentyl, butenyl, octenyl, linoleyl, etc.

Another useful class is composed of hydrocarbon soluble molybdenum(VI) dialkyl phosphates, phosphorothioates and phosphorodithioates which are derived from a phosphorus containing moiety of the formula:

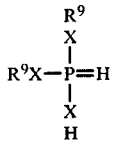

wherein each X can be independently selected from oxygen or sulfur and each $R^9$ is independently selected from hydrocarbon alkyl and aryl groups having from one to about 30 carbon atoms. Examples of these molybdenum(VI) compositions are:

molybdenum-dimethylphosphorothioate
molybdenum-dioctylphosphorothioate
molybdenum-diphenylphosphate
molybdenum-dicresylphosphate
molybdenum-didecylphosphorodithioate
molybdenum-diamylphosphorotetrathioate
molybdenum-di-tert-butylphosphorotrithioate
molybdenum-dixylylphosphorothioate
molybdenum-di-4-ethylphenylphosphorotrithioate
molybdenum-dioctadecylphosphorotetrathioate
molybdenum-cresylphenylphosphate
molybdenum-dinaphthylphosphorothioate
molybdenum-diisopropylphosphorothioate
molybdenum-dibenzylphosphate
molybdenum-dicresylphosphorodithioate
molybdenum-di-4-dodecylphenylphosphorodithioate
molybdenum-dibenzylphosphorodithioate
molybdenum-dilaurylphosphorodithioate
molybdenum-di-2-ethylhexylphosphorodithioate
molybdenum-dicyclohexylphosphorodithioate
molybdenum-diisoamylphosphorodithioate
molybdenum-dioctadecylphosphorodithioate
molybdenum-diundecylphosphorodithioate
molybdenum-diheptylphosphorodithioate
molybdenum-di-2,6-tert-butylphenylphosphorodithioate
molybdenum-diethylphosphorodithioate
molybdenum-ditetradecylphosphorodithioate
molybdenum-diacetylphosphorodithioate
mmolybdenum-di-2,4-didodecylphenylphosphorodithioate
molybdenum-dihexylphosphorodithioate and the like. Other compounds are taught by Revukas in U.S. Pat. Nos. 3,440,028 and 3,401,184 which are expressly incorporated by reference herein. However, phosphorus is currently considered harmful to catalytic converters. Consequently, phosphorus containing compounds are not preferred for use in the practice of this invention.

Still another class of hydrocarbon soluble molybdenum(VI) compounds which can be used in accordance with this invention comprises molybdenum(VI) carboxylates such as those disclosed by Cavitt in U.S. Pat. No. 3,595,891 and Hnizda in U.S. Pat. No. 3,755,195 which are expressly incorporated by reference herein.

Examples of suitable molybdenum(VI) carboxylates of this type are molybdenum pentanoate, molybdenum octanoate, molybdenum oleate, molybdenum linoleate, molybdenum adipate, molybdenum 2-ethylhexanoate, molybdenum benzoate, molybdenum tetradecanoate, molybdenum orthophthalate, molybdenum 4-dodecylbenzoate, molybdenum stearate, molybdenum laurate and the like. Molybdenum(VI) salts of mixtures of fatty acids obtained from natural products such as olive oil, tall oil, cottonseed oil, tallow, coconut oil and the like are also useful. Other molybdenum(VI) compounds of this type are the salts of alicyclic carboxylic acids. Specific examples of useful molybdenum(VI) salts of alicyclic carboxylic acids are molybdenum cyclopentanecarboxylate, molybdenum cyclopentylacetate, molybdenum 3-methylcyclopentylacetate, molybdenum camphoate, molybdenum cyclohexanecarboxylate, molybdenum 3-dodecylcyclohexanecarboxylate, molybdenum 2,6-dicyclohexylcyclohexanecarboxylate, molybdenum 2-cyclohexyl-4,6-dipentyl-4-methylcyclohexanecarboxylate, molybdenum 4-methylcyclohexanecarboxylate, molybdenum 2,2,6-trimethylcyclohexanecarboxylate and the like.

Another class of hydrocarbon soluble molybdenum(VI) compositions which is useful in the practice of this invention are salts of the so-called naphthenic acids. The term "naphthenic acids" is applied to a mixture of carboxylic acids obtained from the alkali washes of petroleum. These acids are complex mixtures of normal and branched aliphatic acids, alkyl derivatives of cyclopentane- and cyclohexane-carboxylic acids and cyclopentyl and cyclohexyl derivates of aliphatic acids. The alicyclic carboxylic acids appear to be the major constituents of these mixtures. The composition of these naphthenic acids will vary depending on factors such as the source of petroleum, the refining procedure, etc. A more detailed discussion of these naphthenic acids is presented in "Chemical Technology of Petroleum," William A. Gruse and Donald R. Stevens, 3rd edition, pp. 65–67, 1960, McGraw-Hill Publishing Company, which is incorporated by reference.

Molybdenum(VI) sulfonates wherein the sulfonate moiety has the general formula:

$$ArSO_3^-$$

can also be used in the practice of this invention. Sulfonic acid compounds useful to prepare molybdenum(VI) sulfonates can have the following general formula:

$$XSO_3—(Ar)_n—A_m$$

wherein A is hydrogen, an alkyl, or other hydrocarbyl group with hydroxy-, chloro-, or bromo-substituents; Ar is an aryl unit including benzene, naphthalene, etc.; m is an integer of 1 to 5; n is an integer of 0 to 5; and X is a halogen or hydrogen. A can be any substantially hydrocarbyl or substituted hydrocarbyl group which results in a hydrocarbon benzene sulfonic acid. A can be a hydrogen or a substantially aliphatic group with about 1 to 15 carbon atoms, such as methyl, ethyl, propyl, isopropyl, butyl, t-butyl, nonyl, decyl, dodecyl, pentadecyl and the like, with a molecular weight of about 120 and greater; an intermediate molecular weight alkyl group such as polyisobutylene or polypropylene polymers with 15 to 1,000 carbon atoms with a molecular weight of about 200 to 14,000; a high molecular weight hydrocarbyl such as polyolefin having a number average molecular weight in excess of 14,000; and others. A can be substituted with groups such as chlorine, bromine, or hydroxy groups. Also, Ar can have more than one substituent, for example, alkyl, hydroxyalkyl, or haloalkyl.

Other suitable oil soluble benzenesulfonic acids are the oil soluble, so-called petroleum sulfonic acids which are also commonly referred to as mahogany acids, having a molecular weight from about 350 to 750, aryl sulfonic acids, and alkaryl sulfonic acids. Examples of other suitable sulfonic acids are diparaffin wax-substituted phenolsulfonic acid, cetylchlorobenzenesulfonic acid, cetylphenoldisulfidesulfonic acid, cetylphenolmonosulfidesulfonic acid, etc. Other suitable oil-soluble sulfonic acids are well described in the art such as U.S. Pat. Nos. 2,616,604; 2,626,207; 2,767,209; and others. The inexpensive, low molecular weight polypropylbenzenesulfonic acids having a molecular weight of about 200 to 1,200 are preferred.

Another class of useful compounds is comprised of molybdenum(VI) phenates which are the reaction product of a molybdenum compound and a phenol compound. Examples of useful phenol compounds include:

4-methylphenol,
4-octadecylphenol,
4-oleylphenol,
4-(2-ethyl-n-hexyl)phenol,
2,6-dimethylphenol,
2,4,6-trimethylphenol,
o-chlorophenol,
2-dodecylphenol,
2,4-didodecylphenol,
p-nonylphenol,
2-tert-butylphenol,
4-dodecylphenol,
4-polyisobutylene substituted phenol,
and the like.

An especially useful type of a molybdenum(VI) phenate is that derived from a commercial mixture of alkylated phenols. Commercial alkylation of phenols generally is accomplished by treating the phenol with an olefin, or polyolefin or mixtures thereof in the presence of an alkylating agent. This commercial alkylation ordinarily produces a mixture of various alkyl phenols. For example, if a phenol is alkylated with a $C_9$ olefin, the product will contain monononylphenols, dinonylphenols, and trinonylphenols. Likewise, if a mixture of $C_9$, $C_{10}$, and $C_{18}$ olefins is used in the alkylation, a mixture of various $C_9$, $C_{10}$, and $C_{18}$ alkylated phenols is obtained.

Still another class of hydrocarbon soluble molybdenum(VI) compounds includes alkoxides and aryloxides that can be prepared by reacting a molybdenum halide compound with an alcohol or a phenol, for example:

$$MoO_2Cl_2+2ROH=MoO_2(OR)_2+2HCl$$

Preferred hydrocarbon soluble molybdenum(VI) compounds, for reasons of solubility in gasoline and lubricating oil and the substantial reduction of octane requirement increase and equilibrium octane requirement, include cis-dioxobis(dipivaloylmethanato)molybdenum(VI), $MoO_2(THD)_2$ and transdioxobis(-dipivalolylmethanato)molybdenum(VI), molybdenum(VI) octoate and naphthanate, methylenebis(2-oxo-4-dodecylphenol)molybdenum (VI), dioxo-N,N'-(2-oxo-4-nonylbenzyl)ethylenediaminemolybdenum(VI), molybdenum(VI) sulfonate, and molybdenum(VI) polyamine-Mannich complex comprising the reaction product of a molybdenum compound and a Mannich reactant product of an alkylphenol, formaldehyde, or a formaldehyde-yielding compound and a polyamine, and the reaction product of a molybdenum compound with the material formed by reacting an olefin with phosphorus pentasulfide.

The foregoing compounds are intended to be exemplary of hydrocarbon soluble molybdenum(VI) compounds known and preferred at this time, and should not be used to unduly limit the scope of the invention.

In somewhat greater detail, the improved gasolines and lubricants of this invention having the ability to prevent substantial octane requirement increase and to reduce high equilibrium octane requirement are produced by combining a gasoline or a lubricating oil with an amount of a hydrocarbon soluble hexavalent molybdenum compound which is effective to reduce elevated steady state octane requirement and/or suppress octane requirement increase.

Varying threshold concentrations exist for each of many molybdenum(VI) compounds for reduction of the octane requirement increase. The threshold for each compound lies between about 0.01 and 3.0 parts of molybdenum per one million parts of gasoline. The threshold concentration varies due to the effect on the molybdenum of the radicals or groups attached. In new engines, the concentration of the molybdenum can range from 0.01 to about 10 parts of molybdenum per million parts of gasoline to prevent substantial increase in octane requirement. In "dirty" engines, i.e., engines that have been operated on unleaded gasoline not containing molybdenum compounds, which have reached a high steady state octane requirement, a gasoline containing about 10 to about 1000 parts of molybdenum per million parts of gasoline can be used until the steady state octane requirement has been reduced to near the "clean" octane requirement level. At that point, the concentration of the molybdenum in the gasoline can be reduced to about 0.01 to about 10.0 parts per million parts of gasoline.

The hydrocarbon fuels to which the molybdenum(VI) compounds can be added comprise hydrocarbons boiling in the gasoline range which range is normally about 20° C.–225° C. The base fuel can comprise straight-chain or branched-chain paraffins, cycloparaffins, olefins, and aromatic compounds or any mixture of such hydrocarbons obtainable from straight-run naphtha, polymeric gasoline, natural gasoline, thermally or catalytically cracked hydrocarbon stocks, alkylate gasoline and catalytically reformed stocks. The fuels can have a research octane number of about 60 to about 100 or preferably about 85 to about 95 for reason of fuel economy and engine performance. The gasoline may also contain conventional gasoline additives such as nonmetallic antiknock compounds, dyes, antioxidants, anti-icing agents, rust inhibitors, detergents, anti-preignition agents, stabilizers, intake valve deposit control additives and the like. Commonly, gasolines contain a carrier fluid which remains stable and fluid in the induction system and can promote induction system cleanliness by dissolving hydrocarbon soluble deposits. A preferred embodiment of the invention involves the use of a minor amount of methyl t-butyl ether as an antiknock agent.

The molybdenum(VI) compounds are effective in lubricant compositions when used in amounts providing about 0.001 to about 5 wt %, preferably about 0.01 to about 2 wt % and more preferably about 0.01 to about 1 wt % of molybdenum(VI) compound based on the oil. Suitable lubricating base oils are mineral oils, petroleum oils, synthetic lubricating oils, and natural lubricating oils of animal or vegetable origin. Concentrates of the additive in appropriate base oils containing about 10 to about 90 weight percent of the additive based on the oil are convenient for producing finished lubricants by dilution with additional base oil. A variety of other additives can be used beneficially with the additives of this invention, including antioxidants, dispersants, corrosion inhibitors, wear inhibitors, friction modifiers, detergents, antibacterial agents, antifoam agents, etc.

The gasoline soluble molybdenum compounds are tested for ORI suppression and elevated steady state octane requirement reduction using the CRC E-15 technique with primary reference fuels and full boiling range reference fuels on an engine dynomometer. A GM 3.7 liter (231 cubic inch) V-6, and a Ford 2.3 liter (140 cubic inch) 4-cylinder in-line engine were connected to a load dynomometer. The fuel line is connected via a valve to a test fuel containing various concentrations of molybdenum compound and other containers containing standard fuel having known octane numbers. The conditions of the test are as follows: the temperature of the coolant and oil is maintained at 93° C. (200° F.)±6° C. (10° F.), the temperature of the inlet air was 40° C.–49° C. (110° F.–120° F.), and the temperature of the transmission was maintained at 82° C. (180° F.)±6° C. (10° F.). The air/fuel ratio was held at about stoichiometric, ignition timing and exhaust gas recirculation was maintained at the stock value. The engine was operated on fuel with and without gasoline soluble molybdenum compound for up to 30,000 equivalent miles. At intervals of 4,000 equivalent miles the standard test fuels were burned in the engine to determine the octane requirement of the engine. After the octane requirement was determined the engines were returned to the test fuel.

The following are examples of the preparation of gasoline soluble additive compounds used in gasoline and tables of test results displaying the octane requirement activity of molybdenum compounds in the engine. The examples and tables of data are illustrative of the invention. Since many embodiments of the invention can be made, the examples and data should not be used to limit the scope of the invention.

EXAMPLE I

Into a 3-liter, three-neck flask equipped with a mechanical stirrer, thermometer, temperature control assembly, and an addition funnel and condenser on a side arm adapter was charged 2 liters of anhydrous dioxane, a slurry of 180 grams (1.55 moles) of anhydrous methyl trimethyl acetate, and 144 grams (3.0 moles) of a 50 percent oil dispersion of sodium hydride. The mixture was stirred and heated to reflux and 160 grams (1.60 moles) of dry pinacolone (3,3-dimethyl-2-butanone) and 200 milliliters of anhydrous dioxane were added dropwise to the stirred and heated mixture over a period of 2 hours. After the addition of the pinacolone was complete, the mixture was held at reflux for 5.5 hours. From the mixture hydrogen gas was evolved. The reaction mixture was chilled in an ice bath and 360 milliliters of concentrated hydrochloric acid were cautiously added to the cold mixture. The resulting acidified mixture was poured into a 6-liter separatory funnel containing 1 liter of water and was extracted with 700 milliliters of pentane. The pentane phase was repeatedly washed with water, dried over magnesium sulfate, and distilled to 93° C. to remove pentane. Crude 2,2,6,6-tetramethylheptane-3,5-dione (THDH) (260.7 grams) in oil was recovered. This procedure was repeated three times and the preparations were combined and fractionally distilled to recover 531.6 grams of THDH.

EXAMPLE II

Into a 250 milliliter Erlenmeyer flask attached to a reflux condenser was charged a slurry of 50.0 grams (0.29 moles) of 2,2,6,6-tetramethyl-3,5-heptanedione (THDH) and 9.8 grams (0.09 moles) of molybdenum trioxide ($MoO_3$). The mixture was stirred magnetically and was heated to reflux for 20 hours. The amber colored solution was filtered and upon standing changed to a blue-green solution. The mixture contained 11.5 wt. % molybdenum. Crystals of cis-dioxobis(dipivaloylmethanato)molybdenum(VI) or $MoO_2(THD)_2$ were recovered upon slow evaporation of the excess ketone.

EXAMPLE III

Into a 500 milliliter Erlenmeyer flask equipped with a distillation trap and condenser was charged a slurry of 138 grams (0.75 moles) of 2,2,6,6-tetramethyl-3,5-heptanedione (THDH) and 27.0 grams (0.188 moles) of $MoO_3$. The mixture was stirred and was heated on a hot plate to reflux. The mixture was allowed to react for a period of 25.5 hours while 5.0 milliliters of water were azeotropically removed from the reaction mixture (1.48 moles of water per mole of molybdenum trioxide). The dark red brown solution was filtered hot. The filtrate solidified to a dark brown mass upon standing. The recovered substance was identified as trioxotetra(dipivaloylmethanato)dimolybdenum(V,VI) by IR and NMR spectra and also by ESCA spectra of the product from a similar preparation.

EXAMPLE IV

Into a 500 milliliter Erlenmeyer flask equipped with a distillation trap and condenser assembly was charged a slurry of 36.4 grams (0.25 moles) of $MoO_3$ and 196.1 grams (1.06 moles) of THDH. The mixture was stirred magnetically and heated to reflux temperature. After 18.5 hours, 6.0 milliliters of water were azeotropically removed (1.32 moles of water per mole of molybdenum trioxide). The reaction mixture was centrifuged and the centrifugate solidified upon standing. The reaction product contained both molybdenum(VI) and molybdenum(V) chelate as shown by a singlet M—O absorbance and a doublet O—Mo—O absorbance in the IR spectrum.

EXAMPLE V

Into a 500 milliliter Erlenmeyer flask equipped with a condenser assembly and distillation trap was charged a slurry of 9.8 grams (0.7 moles) of molybdenum trioxide and 50 grams (0.27 moles) of THDH. The mixture was stirred mechanically and was heated to reflux for 14.5 hours. 1.6 milliliters of water were azeotropically removed (1.31 moles of water per mole of molybdenum trioxide). The THDH in the distillation trap was returned to the reaction mixture, and the mixture was then stripped in vacuum of excess THDH. The resulting product was recrystallized from ethanol. Trans-dioxo(dipivaloylmethanato)molybdenum(VI) chelate (3.2 grams) was recovered as a first crop from the more soluble cis isomer.

EXAMPLE VI

Into a 5-liter, three-neck flask equipped with a mechanical stirrer, thermometer, gas-sparge assembly, side arm adapter and dropping funnel and distillation trap condenser was charged a mixture of 110.0 grams (5.0 moles) of nonylphenol and 150.3 grams (2.5 moles) of ethylenediamine. The mixture was stirred and heated to a temperature of 93° C. under a nitrogen atmosphere. To this stirred and heated mixture was added 405.8 grams (5.0 moles) of 37 wt % aqueous formaldehyde solution. The mixture was stirred and reacted for 0.5 hour at 93° C. Volatiles were removed from the reaction mixture by stripping with nitrogen over 75 minutes at 121° C. The resulting product was filtered through celite.

Into a 500 ml, three-neck flask equipped with a mechanical stirrer, thermometer, sparge assembly, side arm adapter and dropping funnel, distillation trap and condenser assembly was charged 104.8 grams (0.2 mole) of the above reaction product, 28.8 grams (0.2 mole) molybdenum trioxide and 100 milliliters of xylene. The mixture was stirred and heated to 149° C. Water was removed azeotropically with a nitrogen stream. After 30 minutes at 149° C., 3.6 milliliters of water were removed. The product was filtered through celite and isolated by stripping to 149° C. with nitrogen. The dark brown product, which solidified on cooling, contained 11.8 wt % molybdenum and was identified as dioxo-N,N'-(2-oxo-4-nonylbenzyl)ethylenediaminomolybdenum(VI).

EXAMPLE VII

To a 500 milliliter Erlenmeyer flask equipped with a magnetic stirrer and heater was charged 54 grams of molybdic oxide ($MoO_3$), 106 grams of water and 22.5 grams of 28 percent aqueous ammonia. The mixture was stirred and heated until dissolution. The ammonium and molybdate product was charged to a 3-liter 3-neck flask equipped with a reflux condenser, water trap, dropping funnel and gas inlet tube containing 500 milliliters of normal heptane and 100 grams of a Mannich product comprising the reaction product of a polyisobutylene substituted phenol having a molecular weight of about 950, paraformaldehyde and diethylenetriamine and oleic acid. The mixture was stirred and heated at reflux for 4.25 hours. Water of reaction was removed by azeotropic distillation, and the mixture was centrifuged. The product was filtered and stripped of heptane by heating to 138° C. with a nitrogen stream. The product contained 2.2 wt % molybdenum, 1.31 wt % nitrogen, and had a 40° C. viscosity of 2516 SSU.

TABLE I

Evaluation of ORI Suppression with Initially Clean Engines

| Additive | Engine | Eq. ORI | ORI Suppression | Equivalent Miles, $\times 10^3$ |
|---|---|---|---|---|
| Blank (0 ppm Mo) | Ford | 7.5 | — | 0–11 |
| Mo(VI)THD (3 ppm Mo) Example II | Ford | 3.0 | 3.5–4.5 | 0–16 |
| Mo(VI)Mannich Example VII | Ford | 5.0 | 1.5–2.5 | 0–12 |
| Blank (0 ppm Mo) | Ford | 6.5 | — | 0–12 |
| Blank (0 ppm Mo) | GM | 6.5 | — | 0–12 |
| Mo(V-VI)THD (3 ppm Mo) Example IV | GM | 6.0 | 0.5 | 0–10 |
| Mo(V-VI)THD (6 ppm Mo) Example IV | GM | 6.0 | 0.5 | 0–16 |
| Mo(VI)Octoate (6 ppm Mo) | GM | 8.0* | — | 0–8 |
| Mo(VI)Octoate (10 ppm Mo) | GM | 4.5 | 2 | 0–24 |

*Low initial value; correct value probably 6.0 with a 0.5 ORI suppression.

TABLE II

Evaluation of Steady State Octane Requirement Reduction Using Initially Dirty Engines

| Additive | Engine | Eq. ORI | Octane Requirement Reduction | Equivalent Miles, $\times 10^3$ |
|---|---|---|---|---|
| Blank (0 ppm Mo) | Ford | 8.0 | — | 0–8 |
| Mo(VI)Octoate (6 ppm Mo) | Ford | 6.0 | 2 | 8–16 |
| Continued Base Fuel | Ford | 6.0 | 2 | 16–30 |
| Mo(VI)Octoate (50 ppm Mo) | Ford | 6.0 | 2 | 30–32.5 |
| Blank (0 ppm Mo) | GM | 6.5 | — | 0–12 |
| Mo(V-VI)THD (3 ppm Mo) Example IV | GM | 7.0 | −0.5 | 12–22 |
| Mo(V-VI)THD (6 ppm Mo) Example IV | GM | 5.5 | 1.0 | 22–32 |

An examination of Tables I and II shows that only molybdenum(VI) compounds provide measurable suppression of ORI or reduction of elevated steady state octane requirement.

In the initially clean engines (Table I) only the Mo(VI)THD, the Mo(VI)Mannich and the Mo(VI)octoate provided measurable octane requirement increase suppression. The mixed Mo(V-VI)THD at 3 ppm and 6 ppm failed to give any measurable suppression.

In initially dirty engines (Table II) only the Mo(VI)octoate provided reduction of elevated steady state octane requirement. The Mo(V-VI)THD provided no measurable benefit.

We claim:

1. A gasoline fuel composition comprising a major proportion of a liquid hydrocarbon fuel of gasoline boiling range in combination with a molybdenum(VI) compound which is soluble in said hydrocarbon fuel, wherein the amount of said molybdenum(VI) compound is from about 0.1 to about 20.0 parts per one million parts of hydrocarbon fuel, said fuel composition is substantially free of metals other than molybdenum, and said molybdenum(VI) compound is selected from the group consisting of molybdenum(VI) sulfonates, molybdenum(VI) diamine complexes wherein the diamine ligand is of the formula $R^4R^5N—(CR^4R^5)_n—NR^4R^5$ where n is an integer from 1 to 20 and each $R^4$ and $R^5$ is independently selected from the group consisting of hydrogen and alkyl of 1 to 20 carbon atoms, and molybdenum(VI) compounds which are free of nitrogen, sulfur, and phosphorus.

2. A gasoline fuel composition comprising a major proportion of a liquid hydrocarbon fuel of gasoline boiling range in combination with a molybdenum(VI) compound which is soluble in said hydrocarbon fuel, wherein the amount of said molybdenum(VI) compound is sufficient to provide from about 0.01 to about 10 parts of molybdenum per million parts of said hydrocarbon fuel, said fuel composition is substantially free of metals other than molybdenum, and said molybdenum(VI) compound is selected from the group consisting of molybdenum(VI) sulfonates, molybdenum(VI) diamine complexes wherein the diamine ligand is of the formula $R^4R^5N—(CR^4R^5)_n—NR^4R^5$ where n is an integer from 1 to 20 and each $R^4$ and $R^5$ is independently selected from the group consisting of hydrogen and alkyl of 1 to 20 carbon atoms, and molybdenum(VI) compounds which are free of nitrogen, sulfur, and phosphorus.

3. A gasoline fuel composition comprising a major proportion of a liquid hydrocarbon fuel of gasoline boiling range in combination with a molybdenum(VI) compound which is soluble in said liquid hydrocarbon fuel, wherein the amount of said molybdenum(VI) compound is effective to reduce elevated steady state octane requirement in a spark ignition internal combustion engine, said fuel composition is substantially free of metals other than molybdenum, and said molybdenum(VI) compound is selected from the group consisting of molybdenum(VI) sulfonates, molybdenum(VI) carboxylates, molybdenum(VI) salts of naphthenic acids, molybdenum(VI) phenates, molybdenum(VI) alkoxides, molybdenum(VI) aryloxides, molybdenum VI beta-diketone compounds, and molybdenum(VI) diamine complexes wherein the diamine ligand is of the formula $R^4R^5N—(CR^4R^5)_n—NR^4R^5$ where n is an integer from 1 to 20 and each $R^4$ and $R^5$ is independently selected from the group consisting of hydrogen and alkyl of 1 to 20 carbon atoms.

4. A composition as set forth in claim 3 wherein the amount of said molybdenum(VI) compound is sufficient to provide from about 10 to about 1,000 parts of molybdenum per million parts of said hydrocarbon fuel.

5. A composition as set forth in claim 2 wherein said molybdenum(VI) compound is a molybdenum(VI) beta-diketone complex.

6. A composition as set forth in claim 3 wherein said molybdenum(VI) compound is a molybdenum(VI) beta-diketone complex.

7. A composition as set forth in claim 1, 2, or 3 which additionally comprises a minor amount of methyl t-butyl ether which is effective to reduce knock in a spark ignition internal combustion engine.

8. A method for reducing elevated steady state octane requirement in a spark ignition internal combustion engine and maintaining the resulting reduced steady state octane requirement which comprises operating said engine on a first gasoline fuel composition until a reduced steady state octane requirement is achieved and maintaining said reduced steady state octane requirement by operating the engine on a second gasoline fuel composition, wherein said first fuel comprises a major proportion of a liquid hydrocarbon fuel of gasoline boiling range in combination with an amount of a soluble molybdenum(VI) compound which is sufficient to provide from about 10 to about 1,000 parts of molybdenum per million parts of liquid hydrocarbon fuel, wherein said second fuel comprises a major proportion of a liquid hydrocarbon fuel of gasoline boiling range in combination with an amount of a soluble molybdenum(VI) compound which is sufficient to provide from about 0.01 to about 10 parts of molybdenum per million parts of liquid hydrocarbon fuel, and wherein both of said first and second fuels are substantially free of lead, said molybdenum(VI) compound being selected from the group consisting of molybdenum(VI) sulfonates, molybdenum(VI), diamine complexes wherein the diamine ligand is of the formula $R^4R^5N—(CR^4R^5)_n—NR^4R^5$ where n is an integer from 1 to 20 and each $R^4$ and $R^5$ is independently selected from the group consisting of hydrogen and alkyl of 1 to 20 carbon atoms, and molybdenum(VI) compounds which are free of nitrogen, sulfur, and phosphorus.

9. A method for suppressing octane requirement increase in a spark ignition internal combustion engine which comprises operating said engine with the gasoline fuel composition which is set forth in claim 1.

10. A method for reducing elevated steady state octane requirement in a spark ignition internal combustion engine which comprises operating said engine with the gasoline fuel composition which is set forth in claim 3.

11. A method for reducing elevated steady state octane requirement in a spark ignition internal combustion engine having an increased octane requirement of about 2 to about 7 units after operation with gasoline substantially free of lead and molybdenum which comprises operating said engine with a gasoline fuel composition comprising a major proportion of a liquid hydrocarbon fuel of gasoline boiling range in combination with a molybdenum(VI) compound which is soluble in said hydrocarbon fuel, wherein the amount of said molybdenum(VI) compound is sufficient to provide from about 10 to about 1,000 parts of molybdenum per million parts of said hydrocarbon fuel, and the amount of said gasoline fuel composition is effective to reduce said elevated steady state octane requirement by at least about 20%, said molybdenum(VI) compound being selected from the group consisting of molybdenum(VI) sulfonates, molybdenum(VI) diamine complexes wherein the diamine ligand is of the formula $R^4R^5N—(CR^4R^5)_n—NR^4R^5$ where n is an integer from 1 to 20 and each $R^4$ and $R^5$ is independently selected from the group consisting of hydrogen and alkyl of 1 to 20 carbon atoms, and molybdenum(VI) compounds which are free of nitrogen, sulfur, and phosphorus.

* * * * *